United States Patent [19]

Patrician et al.

[11] Patent Number: 4,781,886

[45] Date of Patent: Nov. 1, 1988

[54] METHOD FOR PRODUCING REFRACTORY METAL PARTS OF HIGH HARDNESS

[75] Inventors: Thomas J. Patrician, Monroeton; Vito P. Sylvester, Athens, both of Pa.

[73] Assignee: GTE Products Corporation, Stamford, Conn.

[21] Appl. No.: 161,809

[22] Filed: Feb. 29, 1988

[51] Int. Cl.[4] ..... G22F 1/00

[52] U.S. Cl. ..... 419/49; 419/19; 419/57

[58] Field of Search ..... 419/42, 49, 57, 19

[56] References Cited

U.S. PATENT DOCUMENTS

| | | | |
|---|---|---|---|
| 4,065,302 | 12/1977 | Turillon | 419/57 |
| 4,066,449 | 1/1978 | Havel | 419/32 |
| 4,332,622 | 3/1988 | Jones | 419/31 |
| 4,582,687 | 4/1986 | Asari et al. | 419/42 |
| 4,659,546 | 4/1987 | Kearns | 419/57 |
| 4,673,549 | 6/1987 | Ecer | 419/48 |
| 4,693,863 | 9/1987 | Del Corso | 419/42 |

*Primary Examiner*—Stephen J. Lechert, Jr.

*Attorney, Agent, or Firm*—Donald R. Castle; L. Rita Quatrini

[57] ABSTRACT

A method is disclosed for producing a high hardness refractory metal part, the method comprising hot isostatic pressing a refractory metal part having a density greater than about 98% of the theoretical density in the presence of a pressurizing gas having an atomic size great enough to strain the lattice of the refractory metal at a pressure to exceed the yield strength of the metal to result in the densification of the part to a density of greater than about 98% of the theoretical density. The part is then rapidly cooled. The resulting part has a hardness approaching the hardness of mechanically worked material.

5 Claims, No Drawings

METHOD FOR PRODUCING REFRACTORY METAL PARTS OF HIGH HARDNESS

This invention relates to a method for producing refractory metal parts of high strength and hardness by an isostatic pressing method in which the pressurizing gas is of an atomic size large enough to strain the lattice of the material.

BACKGROUND OF THE INVENTION

In order for high strength, hardness and high density to be achieved in refractory metal parts, they had to be mechanically deformed after sintering. The disadvantages of mechanical deformation are the extra expense and the risk of cracking or otherwise producing a defective part.

U.S. Pat. No. 4,612,162 relates to hot isostatic pressing (HIP) powder metallurgical materials which have been pressed and sintered to closed porosity (about 90 to 91% of theoretical density). The material is hot isostatically pressed to greater than about 97% of the theoretical density. In order to achieve high strength and hardness in the pressed parts, they must still undergo mechanical deformation.

SUMMARY OF THE INVENTION

In accordance with one aspect of this invention, there is provided a method for producing a high hardness refractory metal part, the method comprising hot isostatic pressing a refractory metal part having a density greater than about 98% of the theoretical density in the presence of a pressurizing gas having an atomic size greater enough to strain the lattice of the refractory metal at a pressure to exceed the yield strength of the metal to result in the densification of the part to a density of greater than about 98% of the theoretical density. The part is then rapidly cooled. The resulting part has a hardness approaching the hardness of mechanically worked material.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

This invention provides a method to produce high strength high hardness refractory metal parts without mechanical deformation. The isostatic pressing method involves use of a non-reacting pressurizing gas which has an atomic size which is large enough to strain the lattice of the refractory material at a pressure to exceed the yield strength of the material.

The materials of this invention are most typically refractory metal parts but can be also any powder metallurgical part in which isostatic pressing results in straining of the lattice. Some materials which are especially suited to the method of the present invention are tungsten with about 2% by weight $ThO_2$, pure tungsten, pure molybdenum and molybdenum or tungsten alloys containing Ti, Zr, and C or Hf and C.

The material is in the shape of any article or part capable of being made by powder metallurgical techniques.

A green part is first sintered to at least about 90% of the theoretical density. This can be done by any method.

The sintered part is then hot isostatically pressed. This is done according to standard methods but preferably according to the method described in U.S. Pat. No. 4,612,162. That patent is herein incorporated by reference. However, the pressurizing gas is a non-reacting gas which has an atomic size that is large enough to strain the lattice of the refractory material. Argon gas is especially suited to the practice of the present invention. The internal strain of the lattice increases the mechanical strength of the material which is manifested as high strength and hardness. The hardness and strength of material processed by this invention are comparable to that of mechanically worked material. The density of the resulting part is greater than about 98% of the theoretical density.

The pressures, temperatures and time of hot isostatic pressing are critical can vary depending on factors as the equipment used, the nature of the refractory material etc. The conditions are such that the temperature must be sufficient to saturate the lattice of the material with the pressurizing gas so that the lattice is strained after the HIPing. The length of time of HIPing must be long enough to allow the lattice to be saturated at temperature.

In accordance with a preferred embodiment, the conditions for HIPing are use of argon as the pressuring gas. The pressures of the gas are typically from about 20 to about 75 ksi. The temperature and time vary depending on the pressure. Lower pressures require higher temperatures. Higher pressures and higher temperatures require shorter times. Under the above conditions of pressure of argon, the temperatures range typically from about 1300° C. to about 2500° C. for from about ½ hour to about 4 hours. A still more preferred combination of conditions are from about 20 to about 40 ksi at temperatures of from about 1500° C. to about 1900° C. for from about 1 to 2 hours. The most preferred conditions for this type of material are pressures of from about 25 to about 35 ksi at temperatures of from about 1600° C. to about 1800° C. for from about 1 to about 2 hours.

Table 1 gives some typical refractory materials and hardness data according to the processing they were subjected to.

TABLE 1

| # | Material | Condition | Grain Size | % Theoretical Density | $R_A$ | $R_C$ |
|---|---|---|---|---|---|---|
| 1 | W—2% $ThO_2$ | Sintered | 11.2 | 93.9 | 69.0 | 37.0 |
| 2 | W—2% $ThO_2$ | Sintered + HIP | 11.2 | 98.8 | 71.8 | 42.8 |
| 3 | W—2% $ThO_2$ | Sintered + HIP Worked $\epsilon = 1.5$ | 11.5 | 99.3 | 73.2 | 45.6 |
| 4 | | As in 1, 2, and 3 + recrystallized | 5.0 | 99+ | 69.8 | 38.8 |

TABLE 1-continued

| # | Material | Condition | Grain Size | % Theoretical Density | $R_A$ | $R_C$ |
|---|---|---|---|---|---|---|
| 5 | Pure W | Sintered | 9.3 | 95.9 | 67.9 | 35.0 |
| 6 | Pure W | Sintered + HIP | 9.2 | 97.8 | 69.8 | 38.2 |
| 7 | Mo—Ti—Zr—C | Sintered | 5.0 | 94.5 | 49.9 | |
| 8 | Mo—Ti—Zr—C | Sintered + HIP | 4.5 | 99.2 | 53.8 | |
| 9 | Mo—Hf—C | Sintered | 5.0 | 95.2 | 52.8 | |
| 10 | Mo—Hf—C | Sintered + HIP | 4.5 | 98.2 | 55.8 | |

HIP = Hot Isostatic Pressed at 1700° C. for 2 hr in Argon
$\epsilon$ = total strain It can be seen that the hardness values of parts pressed by the process of the present invention (ie HIP) approach the values of mechanically worked parts. The only other method for achieving the above hardness and strength values is by mechanical deformation.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing a high hardness refractory metal part, said method comprising:

(a) hot isostatic pressing a refractory metal part having a density of at least about 90% of the theoretical density in the presence of a pressurizing gas having an atomic size great enough to strain the lattice of said refractory metal at a pressure to exceed the yield strength of said metal to result in the densification of said part to a density of greater than about 98% of the theoretical density; and (b) rapidly cooling the resulting hot isostatically pressed part to produce said part having a hardness approaching the hardness of mechanically worked material.

2. A method of claim 1 wherein said gas is argon.

3. A method of claim 2 wherein said pressure is from about 20 to about 75 ksi.

4. A method of claim 2 wherein said hot isostatic pressing is done at a temperature of from about 1300° C. to about 2500° C.

5. A method of claim 4 wherein said hot isostatic pressing is done for a length of time of about ½ hour to about 4 hours.

* * * * *